US009138872B2

(12) United States Patent
Flood et al.

(10) Patent No.: US 9,138,872 B2
(45) Date of Patent: Sep. 22, 2015

(54) POLYCRYSTALLINE DIAMOND DRILL BLANKS WITH IMPROVED CARBIDE INTERFACE GEOMETRIES

(71) Applicant: Diamond Innovations, Inc., Worthington, OH (US)

(72) Inventors: Gary Martin Flood, Canal Winchester, OH (US); Joel Vaughn, Groveport, OH (US)

(73) Assignee: Diamond Innovations, Inc., Worthington, OH (US)

( * ) Notice: Subject to any disclaimer, the term of this patent is extended or adjusted under 35 U.S.C. 154(b) by 224 days.

(21) Appl. No.: 13/798,402

(22) Filed: Mar. 13, 2013

(65) Prior Publication Data

US 2014/0262546 A1 Sep. 18, 2014

(51) Int. Cl.

| | |
|---|---|
| ***E21B 10/573*** | (2006.01) |
| ***B24D 18/00*** | (2006.01) |
| ***B24D 99/00*** | (2010.01) |

(52) U.S. Cl.

CPC ..... *B24D 18/00* (2013.01); *B24D 99/005* (2013.01); *E21B 10/5735* (2013.01)

(58) Field of Classification Search

CPC ..... E21B 10/5735

See application file for complete search history.

(56) References Cited

U.S. PATENT DOCUMENTS

| | | | | |
|---|---|---|---|---|
| 5,011,515 | A | 4/1991 | Frushour | |
| 5,351,772 | A | 10/1994 | Smith | |
| 5,355,969 | A | 10/1994 | Hardy et al. | |
| 5,617,928 | A | 4/1997 | Matthias et al. | |
| 5,622,233 | A | 4/1997 | Griffin | |
| 5,848,657 | A | 12/1998 | Flood et al. | |
| 5,862,873 | A * | 1/1999 | Matthias et al. | 175/432 |
| 5,906,246 | A * | 5/1999 | Mensa-Wilmot et al. | 175/432 |
| 5,957,228 | A | 9/1999 | Yorston et al. | |
| 6,026,919 | A | 2/2000 | Thigpen et al. | |
| 6,029,760 | A * | 2/2000 | Hall | 175/432 |
| 6,042,463 | A | 3/2000 | Johnson et al. | |
| 6,068,071 | A | 5/2000 | Jurewicz | |
| 6,189,634 | B1 * | 2/2001 | Bertagnolli et al. | 175/432 |
| 6,401,845 | B1 | 6/2002 | Fielder | |
| 6,408,959 | B2 * | 6/2002 | Bertagnolli et al. | 175/432 |
| 6,447,560 | B2 | 9/2002 | Jensen et al. | |
| 6,488,106 | B1 | 12/2002 | Dourfaye | |
| 6,527,069 | B1 | 3/2003 | Meiners et al. | |
| 2008/0099250 | A1 * | 5/2008 | Hall et al. | 175/426 |
| 2011/0036642 | A1 | 2/2011 | Eyre et al. | |
| 2011/0120782 | A1 * | 5/2011 | Cooley et al. | 175/432 |
| 2012/0103699 | A1 * | 5/2012 | Yu et al. | 175/428 |

FOREIGN PATENT DOCUMENTS

| | | | |
|---|---|---|---|
| EP | 0546725 | A1 | 6/1993 |
| EP | 0601840 | A1 | 6/1994 |
| EP | 0687800 | A1 | 6/1995 |

(Continued)

*Primary Examiner* — William P Neuder

(74) *Attorney, Agent, or Firm* — Keith G. DeMaggio

(57) ABSTRACT

A cutting element and a method of making the superabrasive cutter are disclosed. The cutting element has a substrate and a superabrasive layer. The substrate has an inner face and an annular face. The inner face may have a center. The annular face may have a periphery. A superabrasive layer attaches to the substrate along the inner face and the annular face, wherein the inner face slopes outwardly and upwardly from the center at an angle ranging from between about 1° and about 7° from horizontal.

21 Claims, 6 Drawing Sheets

(56) References Cited

FOREIGN PATENT DOCUMENTS

| | | | |
|---|---|---|---|
| EP | 0720879 | A2 | 7/1996 |
| EP | 0733777 | A2 | 9/1996 |
| EP | 0738823 | A2 | 10/1996 |
| EP | 0764760 | A2 | 3/1997 |
| EP | 0878602 | A2 | 5/1998 |
| EP | 0655548 | B1 | 2/1999 |
| EP | 0655549 | B1 | 2/1999 |
| EP | 0936012 | A1 | 2/1999 |
| EP | 0687798 | B1 | 1/2000 |
| EP | 1527251 | B1 | 1/2008 |

* cited by examiner

POLYCRYSTALLINE DIAMOND DRILL BLANKS WITH IMPROVED CARBIDE INTERFACE GEOMETRIES

TECHNICAL FIELD AND INDUSTRIAL APPLICABILITY

The present invention relates generally to a cutting element and a method of making a superabrasive cutter; and more particularly, to polycrystalline diamond drill blanks with improved carbide interface geometries.

Polycrystalline cubic boron nitride (PcBN), diamond or diamond composite materials are commonly used to provide a superhard cutting edge for cutting tools such as those used in metal machining or rock drilling.

Various polycrystalline diamond cutters have been proposed in which the diamond/carbide interface contains a number of non-planar features designed to increase the mechanical bond and reduce thermally induced residual stresses. However, high tensile residual stresses and high potential shock waves damages still exist at the diamond surface and near the interface in those designs.

Therefore, it can be seen that there is a need for a superabrasive cutter having a high resistance to shock waves when the superabrasive cutter is used to drill rocks.

SUMMARY

In one embodiment, a cutting element may comprise a substrate having an inner face and an annular face, wherein the inner face has a center, the annular face has a periphery; and a superabrasive layer attaching to the substrate along the inner face and the annular face, wherein the inner face slopes outwardly and upwardly from the center at an angle ranging from between about 1° and about 7° degrees from horizontal.

In another embodiment, a cutting element may comprise a substrate having an inner face and an annular face, wherein the inner face has a center, the annular face has a periphery; wherein the inner face and the annular face of the substrate have a plurality of spaced-apart protrusions, wherein the center of the substrate is lower than the periphery of the annular face horizontally.

In yet another embodiment, a method of making a cutting element may comprise steps of providing a substrate having an inner face and an annular face, wherein the inner face has a center, the annular face has a periphery, wherein the inner face and the annular face have uneven geometry which is designed to deflect shock waves during an application; providing a superabrasive layer to the substrate along the inner face and the annular face; and subjecting the substrate and the superabrasive layer to a high pressure high temperature condition.

BRIEF DESCRIPTION OF THE DRAWINGS

The foregoing summary, as well as the following detailed description of the embodiments, will be better understood when read in conjunction with the appended drawings. It should be understood that the embodiments depicted are not limited to the precise arrangements and instrumentalities shown.

DETAILED DESCRIPTION

Figure 1:
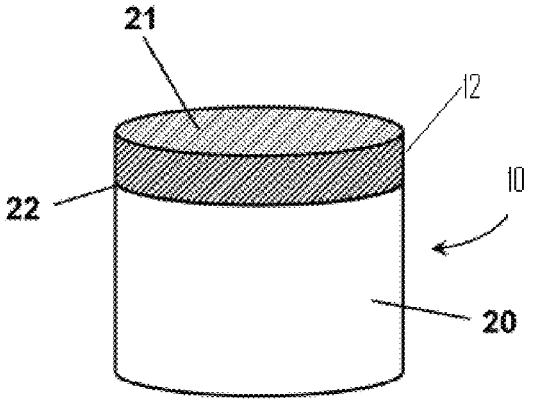
FIG. 1 is schematic perspective view of a cylindrical shape cutting element produced in a HPHT process.

Before the present methods, systems and materials are described, it is to be understood that this disclosure is not limited to the particular methodologies, systems and materials described, as these may vary. It is also to be understood that the terminology used in the description is for the purpose of describing the particular versions or embodiments only, and is not intended to limit the scope. For example, as used herein, the singular forms "a," "an," and "the" include plural references unless the context clearly dictates otherwise. In addition, the word "comprising" as used herein is intended to mean "including but not limited to." Unless defined otherwise, all technical and scientific terms used herein have the same meanings as commonly understood by one of ordinary skill in the art.

Unless otherwise indicated, all numbers expressing quantities of ingredients, properties such as size, weight, reaction conditions and so forth used in the specification and claims are to be understood as being modified in all instances by the term "about". Accordingly, unless indicated to the contrary, the numerical parameters set forth in the following specification and attached claims are approximations that may vary depending upon the desired properties sought to be obtained by the invention. At the very least, and not as an attempt to limit the application of the doctrine of equivalents to the scope of the claims, each numerical parameter should at least be construed in light of the number of reported significant digits and by applying ordinary rounding techniques.

As used herein, the term "about" means plus or minus 10% of the numerical value of the number with which it is being used. Therefore, about 50 means in the range of 45-55.

As used herein, the term "superabrasive particles" may refer to ultra-hard particles having a Knoop hardness of 5000 KHN or greater. The superabrasive particles may include diamond, cubic boron nitride, for example. The term "substrate" as used herein means any substrate over which the superabrasive layer is formed. For example, a "substrate" as used herein may be a transition layer formed over another substrate.

As used herein, the term "fractal", means an infinite geometric series having the shape of a set arranged similar to the shape of each member of the set and repeating this regularity to develop greater sets. The term "near fractal", means a near infinite geometric series having the shape of a set arranged similar to the shape of each member of the set and repeating this regularity to develop greater sets.

A cutting element, such as polycrystalline diamond composite (or "PDC", as used hereafter) may represent a volume of crystalline diamond grains with embedded foreign material filling the inter-grain space. In one particular case, composite comprises crystalline diamond grains, bonded to each other by strong diamond-to-diamond bonds and forming a rigid polycrystalline diamond body, and the inter-grain regions, disposed between the bonded grains and filled with a catalyst material (e.g. cobalt or its alloys), which was used to promote diamond bonding during fabrication. Suitable metal solvent catalysts may include the metals in Group VIII of the Periodic table. PDC cutting element (or "PDC cutter", as is used thereafter) comprises an above mentioned polycrystalline diamond body attached to a suitable support substrate, e.g. cemented cobalt tungsten carbide (WC—Co), by virtue of the presence of cobalt metal.

In another particular case, polycrystalline diamond composite comprises a plurality of crystalline diamond grains, which are not bonded to each other, but instead are bound together by foreign bonding materials such as borides, nitrides, carbides, e.g. SiC.

Polycrystalline diamond composites and PDC cutters may be fabricated in different ways and the following examples do not limit a variety of different types of diamond composites and PDC cutters which can be coated. In one example, PDC cutters are formed by placing a mixture of diamond polycrystalline powder with a suitable solvent catalyst material (e.g. cobalt) on the top of WC—Co substrate, which assembly is subjected to processing conditions of extremely high pressure and high temperature (HPHT), where the solvent catalyst promotes desired inter-crystalline diamond-to-diamond bonding and, also, provides a bonding between the polycrystalline diamond body and the substrate support.

In another example, PDC cutter is formed by placing diamond powder without a catalyst material on top of the substrate containing a catalyst material (e.g. WC—Co substrate). In this example, necessary cobalt catalyst material is supplied from the substrate and melted cobalt catalyst is swept through the diamond powder during the HPHT process. In still another example, a hard polycrystalline diamond composite is fabricated by forming a mixture of diamond powder with silicon powder and mixture is subjected to HPHT process, thus forming a dense polycrystalline cutter where diamond particles are bonded to newly formed SiC material.

Abrasion resistance of polycrystalline diamond composites and PDC cutters may be determined mainly by the strength of bonding between diamond particles (e.g. when cobalt catalyst is used), or, in the case when diamond-to-diamond bonding is absent, by foreign material working as a binder (e.g. SiC binder), or in still another case, by both diamond-to-diamond bonding and foreign binder.

Exemplary embodiments disclose a polycrystalline diamond cutter with a carbide substrate that forms an interface characterized by contoured geometries which impart higher resistance to both wear and fracture during a drilling application. The geometries favorably distribute residual and applied stress such that fewer diamond chips and fractures occur during rock drilling.

In exemplary embodiments, the contoured geometries may be characterized by a series of radiused protrusions from a plane or from a slope or from a raised land, for example. More specifically, the protrusions may be a series of bumps or of raised arcuate extents which have radii smaller than the radius of the substrate, and displaced in patterns which are favorable to HPHT processing. These patterns also serve to disrupt the residual stress field from HPHT processing as well as to deflect damaging shock waves in the diamond during rock drilling.

As shown in FIG. 1, a cutting element 10 which is insertable within a downhole tool (not shown) according to an exemplary embodiment. One example of the cutting element 10 may include a superabrasive layer 12 having a top surface 21. The superabrasive layer 12 may have superabrasive particles. The cutting element 10 may include a substrate, such as a metal carbide 20, attached to the superabrasive layer 12 via an interface 22 between the superabrasive layer 12 and the metal carbide 20. The metal carbide 20 may be generally made from cemented cobalt tungsten carbide, or tungsten carbide, while the superabrasive layer 12 may be formed using a polycrystalline superabrasive material layer, such as polycrystalline diamond ("PCD"), polycrystalline cubic boron nitride ("PCBN"), or tungsten carbide mixed with diamond crystals (impregnated segments). The superabrasive particles may be selected from a group of cubic boron nitride, diamond, and diamond composite materials.

The cutting element 10 may be fabricated according to processes and materials known to persons having ordinary skill in the art. The cutting element 10 may be referred to as a polycrystalline diamond compact ("PDC") cutter when polycrystalline diamond is used to form the polycrystalline layer 12. PDC cutters are known for their toughness and durability, which allow them to be an effective cutting insert in demanding applications. Although one type of the cutting element 10 has been described, other types of cutting element may be utilized. For example, in some embodiment, superabrasive cutter 10 may have a chamfer (not shown) around an outer peripheral of the top surface 21. The chamfer may have a vertical height of 0.5 mm and an angle of 45° degrees which may provide a particularly strong and fracture resistant tool component.

Figure 2A:
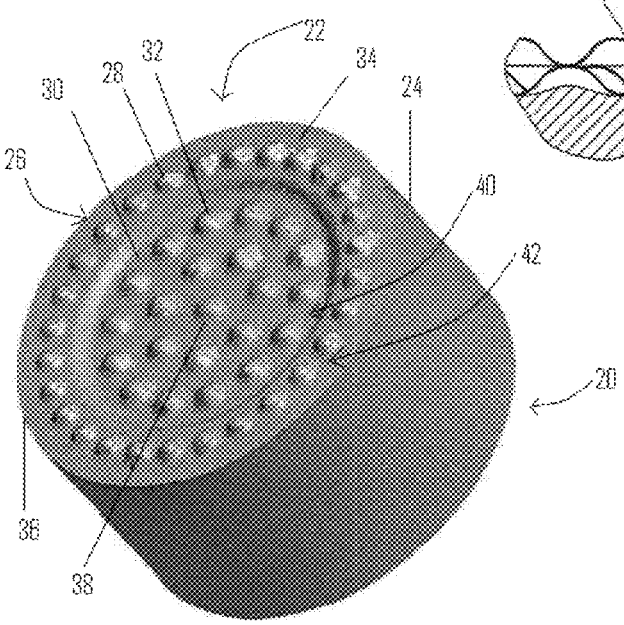
FIG. 2*a* is a perspective view of a substrate of the cutting element according to an exemplary embodiment.

In an exemplary embodiment, as shown in FIG. 2*a*, the interface 22 at one end of the substrate 20 may have an inner face 30 and an annular face 26. The inner face 30 may have a center protrusion 38, which is generally positioned at the geometric center of the inner face 30. The annular face 26 may have a periphery 34. The inner face 30 may be located inside the annular face 26. The abrasive layer (12 shown in FIG. 1) may attach to the substrate 20 along the inner face 30 and the annular face 26. The substrate 20 may be cylindrical and has a peripheral surface 24 and a peripheral top edge 36. The annular face 26 may terminate at the peripheral top edge 36. The annular face 26 and the inner face 30 may have uneven geometry, which is designed to deflect shock waves during an application, such as rock drilling.

Figure 6A:
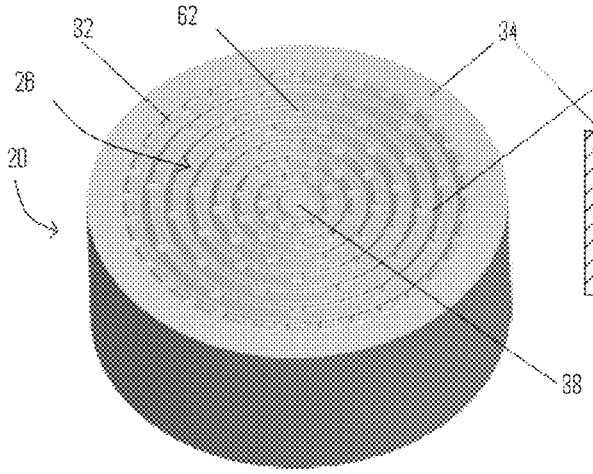
FIG. 6*a* is a perspective view of a substrate of the cutting element according to further another exemplary embodiment.
Figure 6B:
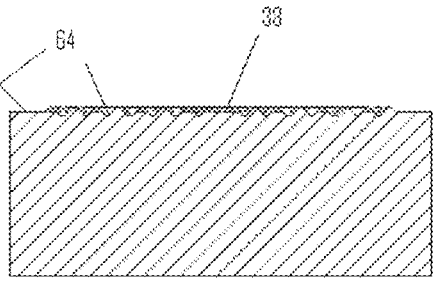
FIG. 6*b* is a cross-sectional view of the substrate according to the exemplary embodiment as shown in FIG. 6*a;*

In an exemplary embodiment, the annular face 26 and the inner face 30 may have uneven levels, forming a step 44 (shown in FIG. 2*b*) therebetween which may be curved, linear, or non-linear. For example, the inner face 30 may be lower or higher than the annular face 26. Alternatively, the inner face 30 and the annular face 26 may be at the same level, as shown in FIG. 6*a*, 6*b*.

The uneven geometry may further include that the inner face 30 having a plurality of protrusions 32 which may be spaced-apart and arranged in a row 40. The protrusions 32 may be located radially inside the annular face 26. In one exemplary embodiment, the row 40 may be disposed in a circular path around the geometric center of the inner face 30. However, the exemplary embodiment may not be limited to this circular geometry, for example, the row 40 may be elliptical or a symmetrical.

The uneven geometry may further include that the annular face 26 may have a plurality of protrusions 28 which may be spaced-apart and arranged in a row 42. The protrusions 28 may be located radially outside the inner face 30. In one exemplary embodiment, the row 42 may be disposed in a circular path around the geometric center of the inner face 30. However, the exemplary embodiment may not be limited to this circular geometry, for example, the row 40 may be elliptical or a symmetrical.

Figure 2B:
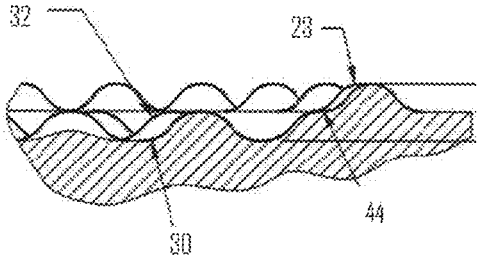
FIG. 2*b* is a cross-sectional view of the substrate according to an exemplary embodiment as shown in FIG. 2*a;*

An end cross-sectional view of one of the protrusions 28 and 32 taken along a diameter plane is shown in FIG. 2*b*. In one exemplary embodiment, the protrusions 28 and 32 may have a smoothly curving upper surface. In another exemplary embodiment, the protrusions 28 and 32 may have grooves, dents, or dimples, for example.

Figure 3A:
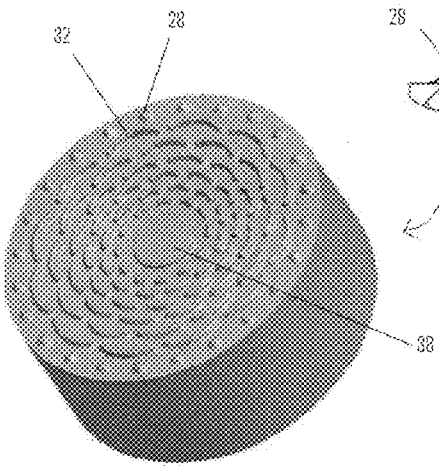
FIG. 3*a* is a perspective view of a substrate of the cutting element according to another exemplary embodiment.
Figure 3B:
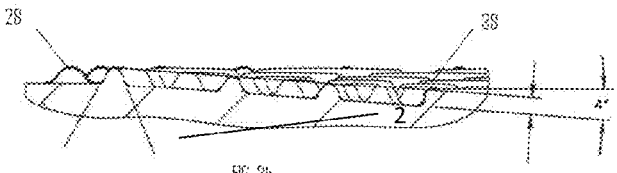
FIG. 3*b* is a cross-sectional view of the substrate according to the exemplary embodiment as shown in FIG. 3*a;*

As shown in FIG. 3*a*, the plurality of protrusions 32 may be spaced-apart arches. The arches may curve toward to the geometric center of the inner face 30. Protrusions 32 may be located radially inside the annular face 26. In one exemplary embodiment, the center protrusion 38 may be cylindrical, for example. The inner face 30 may slope inwardly and downwardly from the annular face 26 towards the geometric center of the inner face 30 at an angle ranging from between about 1° and about 7° degrees from horizontal. As shown in FIG. 3*b*, the angle is about 4° degrees, for example.

In operation, when the cutting element is used in an application, such as a drilling application, the protrusions 32 and arches 32 may deflect shock waves in the superabrasive layer, such as diamond layer. Further, the uneven geometry may favorably distribute residual and applied stress field from high pressure high temperature manufacturing process.

Figure 4A:
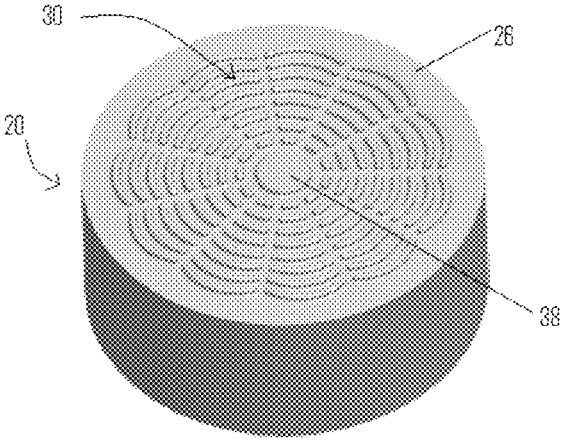
FIG. 4*a* is a perspective view of a substrate of the cutting element according to yet another exemplary embodiment.
Figure 4B:
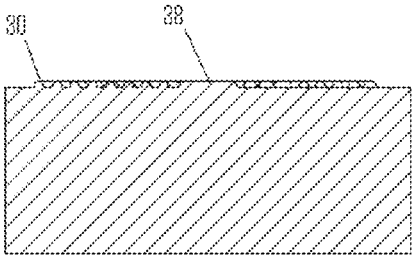
FIG. 4*b* is a cross-sectional view of the substrate according to the exemplary embodiment as shown in FIG. 4*a;*

In another exemplary embodiment, as shown in FIGS. 4*a* and 4*b*, the annular face 26 may be substantially flat. The height of the protrusions (here, the arches 30) may be substantially the same as the center protrusion 38.

Figure 5A:
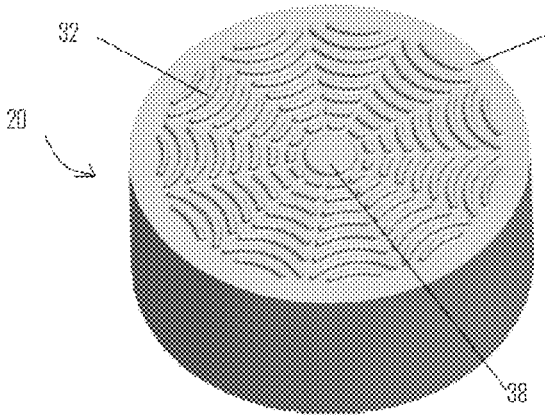
FIG. 5*a* is a perspective view of a substrate of the cutting element according to still another exemplary embodiment.
Figure 5B:
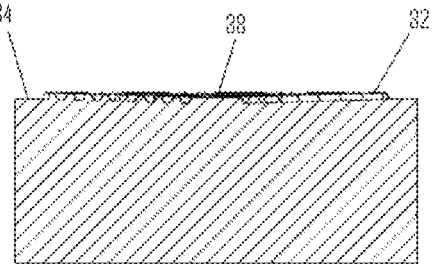
FIG. 5*b* is a cross-sectional view of the substrate according to the exemplary embodiment as shown in FIG. 5*a;*

In yet another exemplary embodiment, as shown in FIGS. 5*a* and 5*b*, the annular face 26 may be substantially flat. The plurality of arches 32 may curve away from the geometric center of the inner face 30. The inner face 30 may slope inwardly and downwardly from the annular face 26 towards the geometric center of the inner face 30.

As shown in FIGS. 6*a* and 6*b*, the annular face 26 may comprise a plurality of protrusions 32, such as concentric annular rings with dimples 62 between the protrusions 32. The inner face 30 may slope inwardly and downwardly from the annular face 26 towards the geometric center of the inner face 30. Due to difference in the coefficients of thermal expansion of the substrate 20 and the superabrasive layer 21 (as shown in FIG. 1), these layers contract at different rates when the cutting element is cooled after HPHT sintering. Tensile stress may be generated on the upper surfaces of the protrusions 32, whereas compressive stress may be generated on the valleys 64 between the protrusions 32. The dimples 62 may be arranged and staggered between protrusions 32 at concentric rings in such a way that shock waves may be deflected during a drilling application.

Figure 7A:
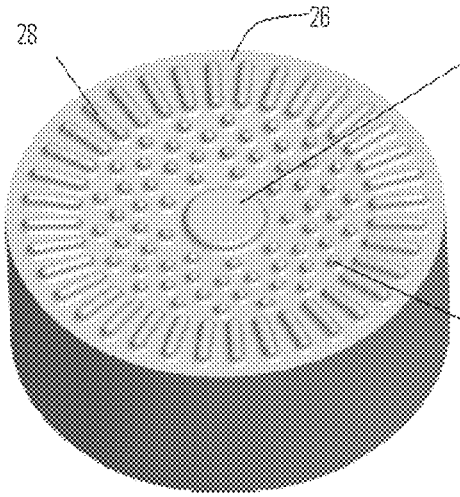
FIG. 7*a* is a perspective view of a substrate of the cutting element according to further exemplary embodiment.
Figure 7B:
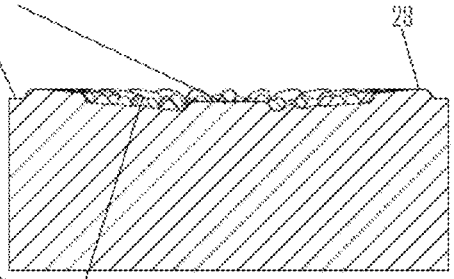
FIG. 7*b* is a cross-sectional view of the substrate according to the exemplary embodiment as shown in FIG. 7*a;*

The protrusions 32 and 28 may take various forms, such as T-bones, chevron, V-shape, inverted V-shape, or ridges as shown in FIG. 7*a*. The inner face 30 may slope inwardly and downwardly from the annular face 26 towards the geometric center of the inner face 30.

Figure 8A:
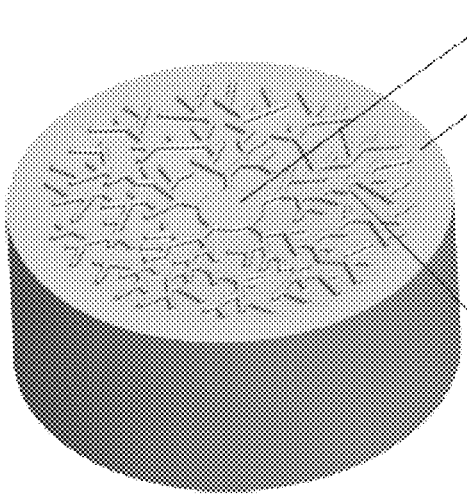
FIG. 8*a* is a perspective view of the substrate of the cutting element according to yet further exemplary embodiment.
Figure 8B:
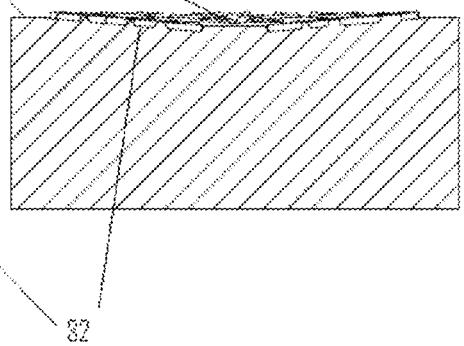
FIG. 8*b* is a cross-sectional view of the substrate according to the exemplary embodiment as shown in FIG. 8*a;*

In another embodiment, the protrusions may be characterized by a near-fractal pattern of linear or curvilinear segments which serve to deflect and dissipate shock waves from multiple directions. A fractal pattern is one which is complex and self-similar across different scales. A near-fractal pattern is less complex and more limited in the scales for which the pattern is self-similar. Such aforementioned segments may be of different heights and thicknesses compared to neighboring segments. As an example, a near-fractal pattern may be based on a linear branching pattern as shown in FIGS. 8*a* and 8*b*. The plurality of protrusions 32, such as linear branching pattern, may stretch away from the center protrusion 38. The inner face 30 may slope inwardly and downwardly from the annular face 26 towards the geometric center of the inner face 30.

Figure 9:
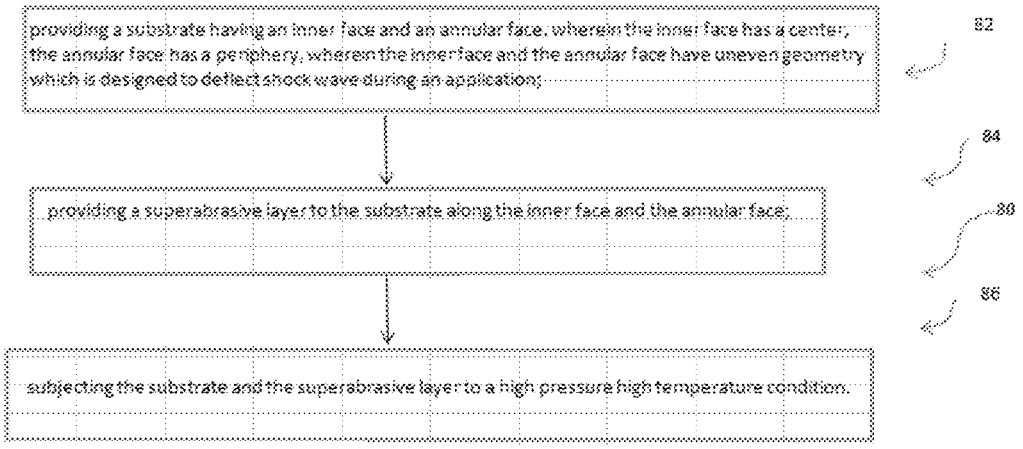
FIG. 9 is a flow chart illustrating a method of making a cutting element according to an exemplary embodiment.

As shown in FIG. 9, a method 80 of making a cutting element may comprise steps of providing a substrate having an inner face and an annular face, wherein the inner face has a center, the annular face has a periphery, wherein the inner face and the annular face have uneven geometry, such as a plurality of protrusions or concentric protrusions, which is designed to deflect shock waves during an application in a step 82; providing a superabrasive layer having superabrasive particles which are selected from a group of cubic boron nitride, diamond, and diamond composite materials, to the substrate along the inner face and the annular face in a step 84; and subjecting the substrate and the superabrasive layer to a high pressure high temperature condition in a step 86. The plurality of protrusions may include at least one of bumps, arches, ridges, chevrons, T-bones. The uneven geometry may include that the inner face may be lower than the periphery of the annular face.

One or more steps may be inserted in between or substituted for each of the foregoing steps 82-86 without departing from the scope of this disclosure.

EXAMPLE 1

Cutters were prepared without a bevel on the diamond edge. They were rigidly held in a clamp fixture by gripping on the outer diameter, leaving a section of the diamond edge exposed. Using an Instron Model instrument, the cutter assembly was raised a designated height above an impact bar. The height and weight of the falling tool assembly, including the cutter, determine the energy of the impact. The impact bar was rectangular with a square cross section. It was made of steel that is through-hardened to a hardness of 60 on the Rockwell C scale.

The cutter was positioned within the fixture assembly so that when it was dropped onto the impact bar, the diamond edge impacts at an angle of 15 degrees relative to the diamond-carbide interface. A cutter that failed under impact displayed cracks and/or chips that are easily visible.

The energy of the drop, and therefore the height of the drop, had been pre-determined to cause some failures in some cutters. As examples, drops of 14 joules, or 20 joules or more, provided a means to distinguish product design behavior by using a scoring metric.

The test method used in the present invention consisted of dropping each cutter up to seven times and then scoring the result. If a cutter survived 1 drop without failure, then failed on the second drop, it got a score of 1 out of 7, or 14%. If a cutter survived all 7 drops without failure, it got a score of 100%. Typically, 10 cutters in each test group were dropped and scored. The comparison scores reflected the relative impact resistance in the drop test mode. A higher score meant a more resistant cutter.

Figure 10:
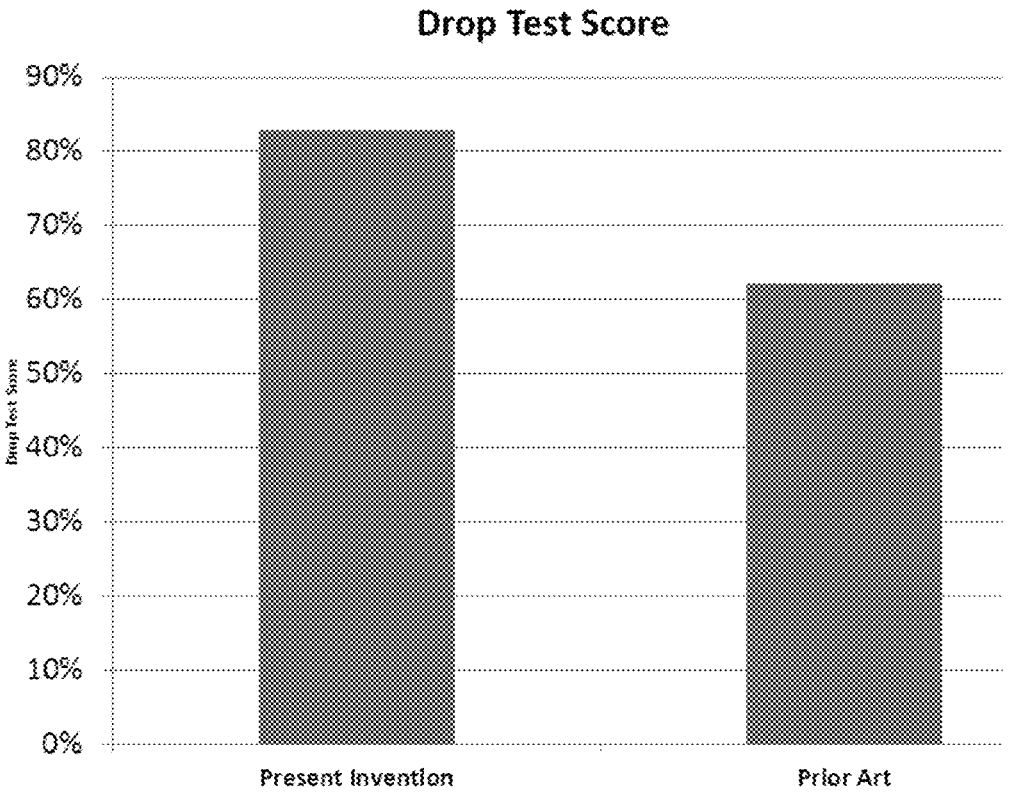
FIG. 10 is a comparison chart illustrating drop test performance between a conventional cutting element with an exemplary embodiment of the cutting element.

The data in FIG. 10 displayed examples of cutters of prior art design versus cutters of the present invention. The present invention cutter design earned a higher score, was more resistant to drop failure, and therefore more likely to be resistant to similar failure modes in the drilling application, thus extending their useful life and reducing the cost of drilling compared to prior art cutters.

While reference has been made to specific embodiments, it is apparent that other embodiments and variations can be devised by others skilled in the art without departing from their spirit and scope. The appended claims are intended to be construed to include all such embodiments and equivalent variations.

We claim:

1. A cutting element, comprising:

a substrate having an inner face and an annular face, wherein the inner face has a geometric center and the annular face surrounds the inner face; and a superabrasive layer attached to the substrate along the inner face and the annular face, wherein the inner face slopes inwardly and downwardly from the annular face towards the geometric center at an angle ranging from between about 1° and about 7° degrees from horizontal.

2. The cutting element of claim 1, wherein the superabrasive layer has superabrasive particles which are selected from a group of cubic boron nitride, diamond, and diamond composite materials.

3. The cutting element of the claim 1, wherein the annular face terminates at a peripheral top edge.

4. The cutting element of the claim 1, wherein the substrate is cemented cobalt tungsten carbide.

5. The cutting element of the claim 1, wherein the substrate further comprises a plurality of protrusions on the inner face.

6. The cutting element of the claim 1, wherein the substrate further comprises a plurality of protrusions on the annular face.

7. The cutting element of the claim 5, wherein the protrusions are at least one of bumps, arches, ridges, chevrons, T-bones, and near fractal.

8. The cutting element of the claim 6, wherein the protrusions are at least one of bumps, arches, ridges, chevrons, T-bones, and near fractal.

9. The cutting element of the claim 5, wherein the plurality of protrusions on the inner face are spaced apart concentric rings.

10. The cutting element of claim 5, wherein the plurality of protrusions are spaced apart from one another.

11. The cutting element of claim 6, wherein the plurality of protrusions are spaced apart from one another.

12. A cutting element, comprising:

a substrate having an inner face and an annular face, wherein the inner face has a geometric center and the annular face surrounds the inner face, wherein the inner face and the annular face of the substrate have a plurality of spaced-apart protrusions extending therefrom including a center protrusion positioned at the geometric center of the inner face, and wherein the center protrusion of the substrate is lower than the annular face vertically.

13. The cutting element of the claim 12, further comprising a superabrasive layer attaching to the substrate along the inner face and the annular face.

14. The cutting element of the claim 13, wherein the superabrasive layer has superabrasive particles which are selected from a group of cubic boron nitride, diamond, and diamond composite materials.

15. The cutting element of the claim 12, wherein the substrate is cemented cobalt tungsten carbide.

16. The cutting element of the claim 12, wherein the protrusions comprise bumps.

17. The cutting element of the claim 12, wherein the protrusions comprise arches.

18. The cutting element of the claim 13, wherein the inner face is positioned lower than the annular face, thereby forming a step between the inner face and the annular face of the substrate.

19. The cutting element of claim 12, wherein at least a portion of the plurality of spaced-apart protrusions have heights that are substantially the same as the center protrusion.

20. The cutting element of claim 12, wherein the plurality of protrusions are concentric with one another.

21. The cutting element of claim 12, wherein the plurality of protrusions are at least one of bumps, arches, ridges, chevrons, T-bones, and near fractal.

* * * * *